United States Patent [19]

Beicht et al.

[11] Patent Number: 4,953,514

[45] Date of Patent: Sep. 4, 1990

[54] DEVICE FOR THE METERED SUPPLYING OF FUEL VAPOR INTO THE INTAKE PIPE OF A COMBUSTION ENGINE

[75] Inventors: Bernd Beicht, Gross-Umstadt; Reinhard Tinz, Gross-Bieberau; Joachim Heinemann, Weinheim, all of Fed. Rep. of Germany

[73] Assignee: Firma Carl Freudenberg, Weinheim/Bergstr., Fed. Rep. of Germany

[21] Appl. No.: 404,857

[22] Filed: Sep. 8, 1989

[30] Foreign Application Priority Data

Sep. 9, 1988 [DE] Fed. Rep. of Germany ..... 3830722

[51] Int. Cl.[5] ..... F02M 39/00

[52] U.S. Cl. ..... 123/520; 123/463; 123/458; 123/521

[58] Field of Search ..... 123/521, 520, 518, 519, 123/458, 463

[56] References Cited

U.S. PATENT DOCUMENTS

| | | | |
|---|---|---|---|
| 4,377,142 | 3/1983 | Otsuka | 123/520 |
| 4,467,269 | 8/1984 | Matsomnra | 123/520 |
| 4,530,210 | 7/1985 | Yamazaki | 123/520 |
| 4,628,887 | 12/1986 | Mitchell | 123/520 |
| 4,671,240 | 6/1987 | Tanaka | 123/463 |
| 4,703,737 | 11/1987 | Cook | 123/520 |
| 4,763,635 | 8/1988 | Ballhause | 123/520 |
| 4,809,667 | 3/1989 | Uranishi | 123/520 |
| 4,865,000 | 9/1989 | Yajima | 123/458 |
| 4,872,439 | 10/1989 | Sonoda | 123/519 |
| 4,901,902 | 2/1990 | Deicht et al. | 123/458 |

*Primary Examiner*—Carl Stuart Miller

*Attorney, Agent, or Firm*—Felfe & Lynch

[57] ABSTRACT

A device for the temporary storing and metered supplying of volatile fuel components present in the free space 22 of a fuel tank system 15 into the intake pipe 1 of a combustion engine 2. The device includes a deaeration pipe 25 which connects the free space 22 with the atmosphere 23 and in which a storage chamber 18 including an absorptive element is disposed. A pipe 20 connects the storage chamber 18 with the intake pipe and can be closed by means of an electromagnetic stop valve 13. An auxiliary valve 21 including a control chamber 14 which can be closed by means of a vacuum controller is disposed between the stop valve 13 and the intake pipe 1. A bypass 4 having an adjustable cross section is provided parallel to the auxiliary valve 21.

12 Claims, 3 Drawing Sheets

| NO. | POSSIBLE DEFECT | SIGNAL (36) | SIGNAL (35) | SIGNAL (9) | SIGNAL (34) | SIGNAL (32) |
|---|---|---|---|---|---|---|
| I | STOP VALVE STUCK OPEN | PARTIAL LOAD | CLOCKED | AS DESIRED | OSCILLATIONS | NONE |
| II | STOP VALVE STUCK CLOSED | " | " | " | " | " |
| III | ADJUSTING MEMBRANE TORN | " | " | " | AMPLITUDE EVALUATION | " |
| IV | CLOSING LINK STUCK OPEN | " | " | " | OSCILLATIONS | " |
| V | CLOSING LINK STUCK CLOSED | " | " | " | " | " |
| VI | PLUG CONNECTION (39) NOT CONTACTED | " | " | " | " | " |
| VII | PIPE FROM STORAGE CHAMBER TO DEVICE NOT CONTINUOUS/NOT CONNECTED | " | " | " | " | " |
| VIII | PIPE FROM DEVICE TO INTAKE PIPE NOT CONTINUOUS/NOT CONNECTED | " | " | " | " | " |
| IX | MONITORING DEVICE (31) OR SENSOR (30) DEFECT | " | " | " | " | " |
| X | PIPE (25) NOT CONNECTED | FULL LOAD | CLOCKED ONCE | BOUNCE | AS DESIRED | " |

FIGURE 3

DEVICE FOR THE METERED SUPPLYING OF FUEL VAPOR INTO THE INTAKE PIPE OF A COMBUSTION ENGINE

BACKGROUND OF THE INVENTION

The invention relates to a device for the temporary storage and metered supply of fuel vapor from a fuel tank system to a combustion engine, wherein the system includes a fuel tank having a free space therein, a deaeration pipe connecting the free space to the surrounding atmosphere, and a storage chamber having an absorptive element incorporated in the deaeration pipe. The device is located between the storage chamber and the engine, and includes an electromagnetic stop valve, a control chamber between the stop valve and the engine, and auxiliary means in the control chamber to change the metering capacity of the stop valve.

Such a device is known from the DE-OS 35 19 292. It is the purpose of this device to avoid an escaping of the fuel vapors which are constantly present in the free space of the fuel tank into the atmosphere. The device makes use of a special deaeration pipe which is disposed between the free space and the atmosphere and in which is incorporated a storage chamber having an absorptive element. The latter mostly is a permeable body of activated carbon which is suited to temporary store a significant amount of volatile fuel. To regenerate the absorptive element fresh air is sucked through the latter during normal operation of the combustion engine; to do so a a pipe is used connecting the storage chamber with the intake pipe of the combustion engine. However, it must be taken into account that at a low rotational speed of the combustion engine and/or at a particularly high degree of saturation of the absorptive element, the fuel/air mixture sucked in by the combustion engine can possibly become "overrich", which can result in malfunctions. Therefore, the pipe can be closed by an electromagnetic stop valve which can be adjusted with regard to the metering capacity by external sensors, on the one hand, and by a subatmospheric pressure in the pipe which affects the closing link, on the other hand.

SUMMARY OF THE INVENTION

It is an object of the invention to ensure an optimum regenerating of the absorptive element as well as an optimum performance in service of the combustion engine.

In the device in accordance with the invention, the auxiliary means is an auxiliary valve located in the control chamber downstream of the stop valve. The position, i.e., the flow capacity, of the auxiliary valve is controlled by a vacuum control which is responsive to the differential pressure between the control chamber and the atmosphere. A bypass in parallel with the auxiliary valve has an adjustable cross-section.

When the engine reaches a low operating rotational speed this results in a relatively high differential pressure which leads to a decrease of the stop valve prepressure. The total metering capacity is correspondingly reduced, which prevents the fuel/air mixture supplied to the combustion engine from becoming overrich. The ability to change the cross-section of the bypass by means of a setting screw permits a very subtle control of the metering capacity of the valve.

On the other hand, reaching a high operating rotational speed results in a relatively reduced differential pressure at the vacuum control which, in turn, leads to a prepressure increase at the stop valve. The total metering capacity is correspondingly increased and, consequently, a correspondingly increased percentage of fresh air is supplied to the combustion engine. Said air passes through the absorptive element and is enriched with fuel components. This does not adversely affect the good operative performance of the combustion engine.

BRIEF DESCRIPTION OF THE DRAWINGS

FIG. 3 is a Table summarizing monitoring signals which result from various conditions.

BRIEF DESCRIPTION OF THE PREFERRED EMBODIMENTS

Figure 1:
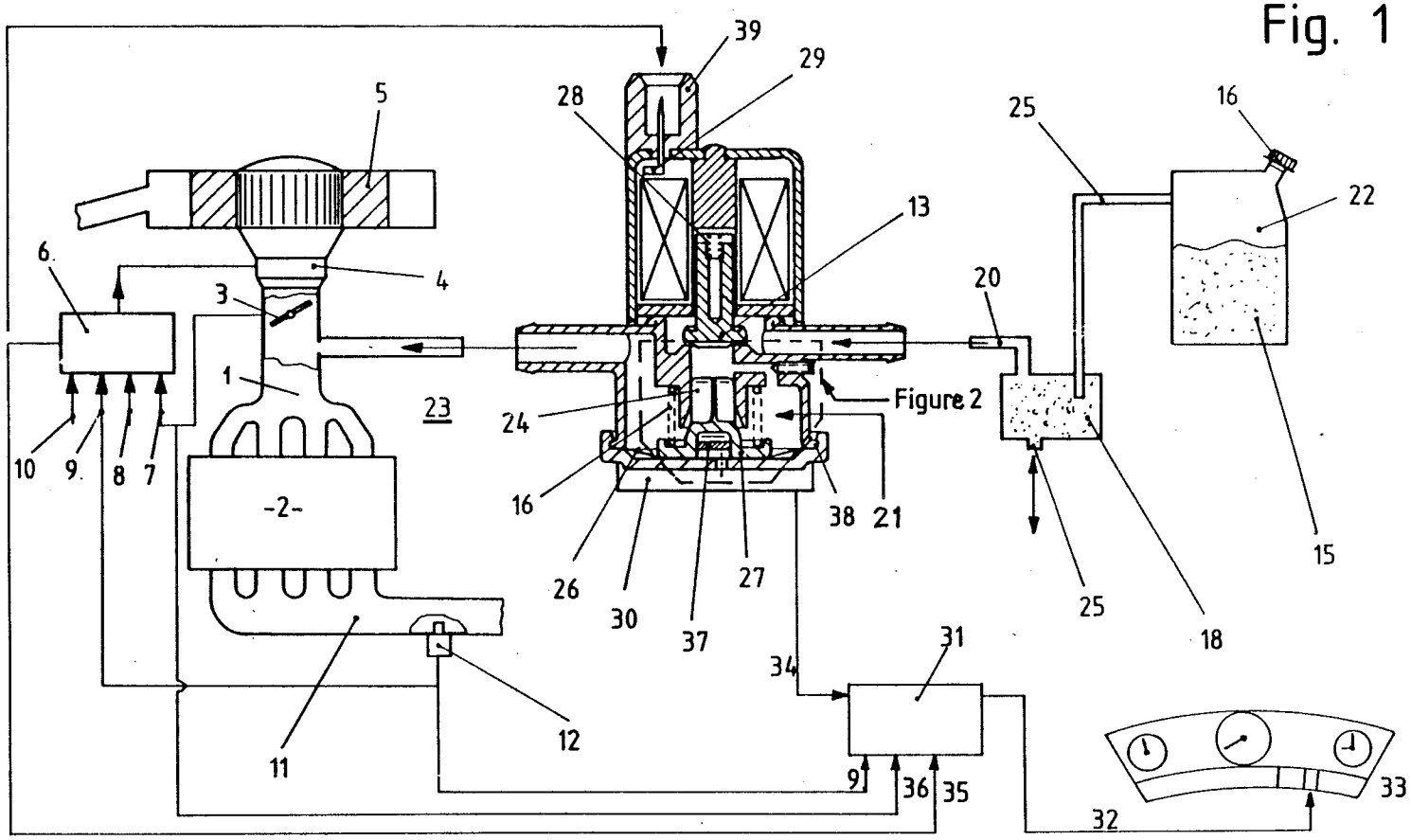
FIG. 1 diagrammatically illustrates the metering device in the system in which it is used.

The schematically represented combustion engine 2 is connected to the air filter 5 via the intake pipe which includes the throttle 3, and via the exhaust manifold 11 to the non-represented exhaust pipe.

In the intake pipe 1 a fuel supply device 4 is provided above the throttle 3. In this fuel supply device 4 the required amount of fuel is added to the fresh air volume supplied by the air filter 5. The necessary signals are supplied by the control device 6, based for example on the temperature and composition of the exhaust gas, the operating rotational speed of the combustion engine and the surrounding temperature. The corresponding input signals which are sensed by corresponding sensors are indicated by arrows 7, 8, 9, 10. They can be supplemented as required.

The fuel tank is only partially filled with fuel 15 and has a free space 22 above the fuel level. The closing 16 of the fuel tank hermetically seals the latter with respect to the surrounding atmosphere.

The deaeration pipe 25 connects the free space 22 of the fuel tank with the atmosphere 23. The deaeration pipe 25 includes a storage chamber 18 which is filled with granular activated carbon. The storage chamber 18 is dimensioned such that volatile fuel components cannot pass the ending of the deaeration pipe 25 under normal operating conditions.

Pipe 20 is connected at the side of the storage chamber 18 opposite the ending of the deaeration pipe 25 and the pipe 20 connects the storage chamber 18 with the intake pipe 1 of the combustion engine 2. The electromagnetic stop valve 13 is disposed in the pipe 20. This valve is closed when the combustion engine is out of operation and can be actuated by means of the control device 6.

The auxiliary valve 21 is between the stop valve 13 and the intake pipe 1. When the combustion engine 2 is out of operation, valve 21 is opened by the effect of the pressure spring 16 which is disposed in the control chamber 14 and fastens on the one side the surrounding support collar of the appertaining closing link 27. The other side of the support collar contacts the side of the adjusting membrane 26 which faces toward the control chamber 14 and separates the control chamber 14 from the atmosphere 23. The closing link 27 includes an extension 24 which extends into the flow passage aperture of the auxiliary valve parallel to the moving direction of the closing link. Both the extension 24 and the aperture in the area engaged thereby are conically configured. The function is explained as follows.

During normal operation of the combustion engine 2 the stop valve 13 is statically open and the volume of the air which is taken in through the storage chamber 18 is controlled by the auxiliary valve 21. The auxiliary valve is adjusted by measuring the differential pressure between the pressure in the intake pipe 1 and the pressure in pipe 20 as well as the atmosphere 23. First, the flow increases with rising differential pressure until a certain control point is reached which is predominantly determined by the design of the pressure spring 16 and the adjusting membrane 26. When the differential pressure further increases the auxiliary valve 21 closes and causes a flow reduction when the combustion engine idles and accelerates. The bypass 40 which has an adjustable cross-section is provided parallel to the auxiliary valve 21.

This permits compensating deviations regarding the actuating accuracy of the auxiliary valve which often occur as a result of mass production. Moreover, the amounts supplied into the intake pipe can be subtly metered and determined by adjusting the aperture cross-section such that normal operation of the combustion engine is ensured when the rotational speed is critical.

Further, the illustrated device includes auxiliary devices which monitor the proper functioning during operation and release a signal to be displayed in case a malfunction occurs. This self-diagnosis avoids any improper function of the driving motor during operation (bucking, bad gas intake) as well as any other increase of exhaust gas emission which cannot be controlled during operation. The monitoring device can be used for service purposes as well as to meet legal requirements and it also improves the technical handling of the device. Moreover, the monitoring device not only monitors the device as such, but also monitors the other components of the system, for example tube connections, electric contacts, etc. The design can be described as follows based on the drawing:

An electrically conductive sensor 30 connected with the monitoring electronic unit 31 is disposed at the auxiliary valve 21 of the device. Any malfunction 32 is displayed on the dashboard 33 of the vehicle. In order to evaluate the signal, the inputs must include at least the sensor signal 34, the signal of the operating position 35 of the stop valve 13, and the signal of the intake pipe subatmospheric pressure 36, e.g. via the position of the throttle, an intake pipe sensor, air volume meter, etc. The monitoring function can be extended by incorporating the Lambda probe signal 9 of the Lambda probe 12 .

The monitoring is carried out as follows:

The combustion engine 2 is in a certain load condition, for example, full load, partial load or idling. This condition is transmitted as a signal 36 to the monitoring electronic unit 31. According to the corresponding operating conditions the device is actuated via a control device 6. Via operating position signal 35 the monitoring electronic unit 31 is informed as to whether the stop valve is statically open, statically closed or actuated by pulses. These two signals provide the desired condition. Sensor 30 and signal 34 compare the latter to the actual condition. If these deviate from each other an error message 33 is released at the signal output 32. The membrane position which is achieved in the individual cases can be determined as follows:

a. A limit switch is actuated by the pressure applied to spring 16 via the closing link 27 to the adjusting membrane 26.
b. A particularly inexpensive measuring can be achieved by means of a Hall sensor 30. In order to generate a magnetic field a permanent magnet 37 can be injected into the closing link 27 or the material of the adjusting membrane 26 can be configured so as to be permanently magnetic, e.g. by including magnetic material in the elastomeric material used for the adjusting membrane.
c. By including an electrically conductive material in the adjusting membrane 26, in the side thereof, that is, facing toward the covering lid 38 and by corresponding conductivity measuring in the sensor 30. When in contact with the covering lid 38 the final position of the adjusting membrane 26 can also be determined.

Membrane oscillations can be determined by attaching a proportional sensitive element to the oscillatory components of the auxiliary valve 21. When the stop valve 13 operates on cycles and via information 16 of the respective load condition of the combustion engine it can be determined whether there is an intended oscillation of the gas column in the auxiliary valve 21. A PE-foil can, for this purpose, be attached in or at the adjusting membrane 26. The signal amplification, processing and contacting is carried out in the sensor 30. Frequency filters filter out interferences caused by the motor, for example, or the car body in the sensor 30 or in the monitoring electronic unit. Gas oscillations can be determined by means of a high-resolution pressure sensor 30. The latter gives information on the oscillation frequency of the gas column and supplies the sensor-signal 34 to the monitoring device 31.

This system permits the reliable and consistent detection of any possible irregularity/defect in the device for the metered supply of volatile fuel components as well as in the remaining system by means of logic operations of a microprocessor in the monitoring electronic unit 31 and the available input signals 9, 34–36. What is covered and monitored is the area of activated carbon chamber 1B to intake pipe 1. Explicitly, the following defects can be detected: malfunction at the stop valve 13, malfunction in the auxiliary valve 21, incorrect actuation of the stop valve 13 (plug came off), blocking of pipes 20 and 38 before and after the compression, defective pipe connections because they were mixed up. The monitoring device (sensor 30 including electronic unit 31) can also be monitored. The subsequent example is to show how a sensor 30 senses the membrane oscillations of the adjusting membrane 26 by means of a piezo-foil and supplies the oscillations as signal 34 to the monitoring device and how signals 35, 36, and 9 detect defects.

Figure 2:
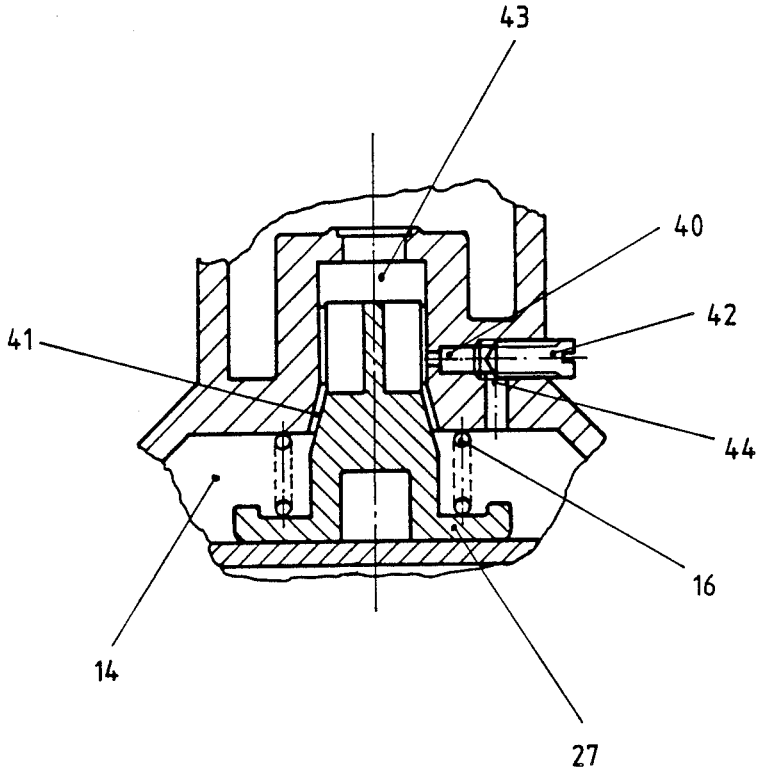
FIG. 2 is an enlarged partial cross-section of the metering device.

In a device for the metered supply of volatile fuel components a bypass 40 (FIG. 2) to the control cross-section 41 of the auxiliary valve 21 is provided to improve the metering capacity. The cross-section 44 of this bypass 40 regulating the flow can be adjusted from the outside by means of an adjusting screw 42 which enlarges or reduces, as required, a cross-section 44 between the monitoring chamber 43 and the control chamber 14. A flow independent from the auxiliary valve 21 can thus be selected as soon as the control cross-section 41 is smaller than the cross-section 44. Especially when there is no more control cross-section 41 available the bypass permits selecting and adjusting any desired flow. The bypass 40 permits compensating deviations regarding the dimensions of the components and the properties, e.g. the closing link 27, the spring 16 or the adjusting membrane 26 with respect to mass production. After the device is installed the flow metering can be carried out via the bypass 40 by a simple turning of the adjusting screw 42.

With respect to a further improved emptying of the storage chamber 18 the possibility of a clocked actuation of the auxiliary valve is given in addition to the present representation. The actual air throughput can be subtly adjusted so as to meet the respective requirements and, in particular, to the respective load condition of the combustion engine 2. When the latter is shut down the stop valve 13 is, by means of the spring 28, closed due to the resulting voltage drop at the electric drive which also reliably suppresses an after-running of the combustion engine even when there is a temporary subatmospheric pressure in the intake pipe 1. When the stop valve actuation is interrupted an unregulated supply of fuel vapors into the intake pipe is also avoided due to the effects of the spring.

We claim:

1. Device for the temporary storage and metered supply of fuel vapor from a fuel tank system to a combustion engine, said fuel tank system comprising a fuel tank having a free space therein, a deaeration pipe connecting said free space to the surrounding atmosphere, and a storage chamber having an absorptive element incorporated in said deaeration pipe, said device being located between said storage chamber and said engine and comprising an electromagnetic stop valve, a control chamber disposed serially between said stop valve and said engine, an auxiliary valve disposed in said control chamber to change the metering capacity of the stop valve, a bypass provided parallel to said auxiliary valve, said bypass having an adjustable cross-section, and vacuum control means for controlling the position of the auxiliary valve, said vacuum control means being responsive to the differential pressure between the control chamber and the atmosphere.

2. Device in accordance with claim 1, wherein the vacuum control is effective against the force of a spring.

3. Device in accordance with claim 2, wherein the spring is configured as a pressure spring and disposed in the control chamber.

4. Device in accordance with claim 3 wherein the vacuum control includes an adjusting membrane disposed between the atmosphere and the control chamber.

5. Device in accordance with claim 4 wherein the auxiliary valve has a separate closing link provided with a support collar and the support collar has one side facing the adjusting membrane and an opposed side facing the pressure spring.

6. Device in accordance with claim 5, wherein the auxiliary valve is provided with a flow passage aperture open parallel to the moving direction of the closing link and the closing link has an extension which passes into the aperture.

7. Device in accordance with claim 6, wherein the extension and the aperture in the area engaged thereby are conically configured.

8. Device in accordance with claim 1 wherein the stop valve is provided with a driving mechanism which can be electrically actuated.

9. Device in accordance with claim 8, wherein the driving mechanism is effective against the force of a spring and when actuated causes the stop valve to open.

10. Device in accordance with claim 8 wherein the driving mechanism is provided with electrical connections which are outside the parts of the stop valve which are in contact with the fuel.

11. Device in accordance with claim 9 wherein the driving mechanism is provided with electrical connections which are outside the parts of the stop valve which are in contact with the fuel.

12. Device in accordance with claim 1 wherein the vacuum control includes an adjusting membrane disposed between the atmosphere and the control chamber.

* * * * *

UNITED STATES PATENT AND TRADEMARK OFFICE

CERTIFICATE OF CORRECTION

PATENT NO. : 4,953,514

DATED : September 4, 1990

INVENTOR(S) : Beicht et al.

It is certified that error appears in the above-identified patent and that said Letters Patent is hereby corrected as shown below:

Column 2, line 22, after "pipe" insert --1--.

Column 4, line 43, "1B" should be --18--.

Signed and Sealed this

Twenty-ninth Day of September, 1992

*Attest:*

DOUGLAS B. COMER

*Attesting Officer*

*Acting Commissioner of Patents and Trademarks*